US011008907B2

(12) United States Patent
Lee et al.

(10) Patent No.: US 11,008,907 B2
(45) Date of Patent: May 18, 2021

(54) APPARATUS FOR CONTROLLING OIL PUMP PRESSURE

(71) Applicants: Hyundai Motor Company, Seoul (KR); Kia Motors Corporation, Seoul (KR)

(72) Inventors: Min Yong Lee, Incheon (KR); Seong Sik Kim, Gyeonggi-do (KR); Jun Sik Park, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/543,914

(22) Filed: Aug. 19, 2019

(65) Prior Publication Data

US 2020/0332683 A1 Oct. 22, 2020

(30) Foreign Application Priority Data

Apr. 18, 2019 (KR) ..... 10-2019-0045280

(51) Int. Cl.
*F01M 1/16* (2006.01)
*F01M 1/08* (2006.01)
*F01M 1/02* (2006.01)

(52) U.S. Cl.
CPC ..... *F01M 1/16* (2013.01); *F01M 1/02* (2013.01); *F01M 1/08* (2013.01)

(58) Field of Classification Search
CPC ..... F01M 1/16; F01M 1/02; F01M 1/08
See application file for complete search history.

(56) References Cited

U.S. PATENT DOCUMENTS 6,240,900 B1 * 6/2001 Thomas ..... G01L 23/225 123/406.21
8,930,096 B2 * 1/2015 Kaimer ..... F04B 49/02 701/51
2013/0179049 A1 * 7/2013 Grieser ..... F01P 3/06 701/102

FOREIGN PATENT DOCUMENTS

KR 20080104563 A * 12/2008

* cited by examiner

*Primary Examiner* — Jacob M Amick
*Assistant Examiner* — Charles Brauch
(74) *Attorney, Agent, or Firm* — Mintz Levin Cohn Ferris Glovsky and Popeo, P.C.; Peter F. Corless

(57) ABSTRACT

An apparatus for controlling oil pump pressure includes a sensor for sensing knocking of an engine, an oil pump configured to determine a pressure for discharging engine oil toward a piston of the engine, and a control unit configured to control the pressure of the engine oil discharged toward the piston by determining whether the knocking occurs based on a parameter transmitted from the sensor for determining whether the knocking occurs, and by controlling the oil pump based on whether the knocking occurs in the engine.

9 Claims, 3 Drawing Sheets

APPARATUS FOR CONTROLLING OIL PUMP PRESSURE

CROSS-REFERENCE TO RELATED APPLICATION

This application claims under 35 U.S.C. § 119(a) the benefit of Korean Patent Application No. 10-2019-0045280 filed on Apr. 18, 2019, the entire contents of which are incorporated herein by reference.

BACKGROUND

(a) Technical Field

The present disclosure relates to an apparatus for controlling oil pump pressure in an engine of a vehicle, more particularly, to the apparatus capable of controlling a pressure for discharging engine oil depending on whether or not engine knocking occurs.

(b) Description of the Related Art

Engine knocking is one of a variety of phenomena that cause deterioration of engine performance Sometimes, abnormal combustion such as explosion may occur in an internal combustion engine depending on a condition in which a compression ratio is increased or an ignition timing comes earlier, or a sound like hammering may be heard in the cylinder of the internal combustion engine, which is referred to as knocking (or knock). If the knocking occurs, the engine may be quickly damaged.

A piston of the engine is subjected to high temperature and high pressure, and the piston is hence seized if it is not properly cooled. As a result, there may be deterioration not only in the life of the piston itself but also in related parts such as a cylinder block and a connecting rod. In order to solve the knocking phenomenon, the piston is required to be properly cooled. For the proper cooling of the piston, oil is conventionally injected into the piston using a cooling jet to cool the piston through heat exchange between the oil and the piston.

Engine knock may be caused by tilting of the vehicle and the engine when a yawing behavior occurs under the condition that the vehicle turns left and right and suddenly stops/starts. A problem may occur in which the piston is not properly cooled since an insufficient amount of engine oil is supplied to the piston due to a sudden change in the traveling state of the vehicle. In addition, in order to control the pressure of the engine oil injected into the piston, a separate check valve and a passage improvement typically are required.

The above information disclosed in this Background section is only for enhancement of understanding of the background of the disclosure and therefore it may contain information that does not form the prior art that is already known in this country to a person of ordinary skill in the art.

SUMMARY

In an aspect, the present disclosure provides an apparatus for controlling oil pump pressure, the apparatus configured to control a pressure of engine oil discharged toward a piston depending on whether or not engine knocking occurs.

In a preferred embodiment, there is provided an apparatus for controlling oil pump pressure. The apparatus includes a sensor for sensing knocking of an engine, an oil pump configured to determine a pressure for discharging engine oil toward a piston of the engine, and a control unit configured to control the pressure of the engine oil discharged toward the piston by determining whether the knocking occurs based on a parameter transmitted from the sensor for determining whether the knocking occurs and by controlling the oil pump based on whether the knocking occurs in the engine.

According to an embodiment, the sensor may include a knocking sensor, and the parameter may be one of a voltage value, whether a bit is generated, and whether a preignition signal is generated, which are sensed through the knocking sensor.

According to an embodiment, the control unit may determine that the knocking occurs in the engine when the bit is generated or the preignition signal is generated.

According to an embodiment, the control unit may control the pressure of the engine oil discharged toward the piston to be greater than or equal to a set value when the knocking occurs in the engine.

According to an embodiment, when the parameter is a voltage value and the voltage value sensed by the sensor is greater than or equal to a preset reference value, the control unit may increase the pressure of the engine oil discharged in proportion to the voltage value.

According to an embodiment, when a current pressure of the engine oil discharged toward the piston is greater than or equal to the set value, the control unit may maintain the pressure of the engine oil discharged toward the piston at the current pressure.

According to an embodiment, the control unit may control the pressure of the engine oil to be greater than or equal to a set value when the knocking occurs in the engine.

According to an embodiment, the control unit may control the pressure at which the engine is discharged according to an existing oil pressure control map when it is determined that the knocking does not occur in the engine.

According to an embodiment, the control unit may control the pressure of the engine oil discharged toward the piston depending on whether knocking occurs, based on any one of a normal mode and a high-pressure mode, the high-pressure mode may mean that the pressure at which the engine oil is discharged when the knocking occurs in the engine is greater than or equal to a set value, and the high-pressure mode may be a mode for discharging the engine oil at a higher pressure than in the normal mode.

According to an embodiment, the apparatus may further include a cooling jet for injecting the engine oil toward the piston, and the control unit may control the oil pump to control the pressure of the engine oil in a main gallery connected to the cooling jet.

Other aspects and preferred embodiments of the disclosure are discussed infra.

BRIEF DESCRIPTION OF THE DRAWINGS

The above and other features of the present disclosure will now be described in detail with reference to certain exemplary embodiments thereof illustrated the accompanying drawings which are given hereinbelow by way of illustration only, and thus are not limitative of the present disclosure, and wherein.

Figure 1:
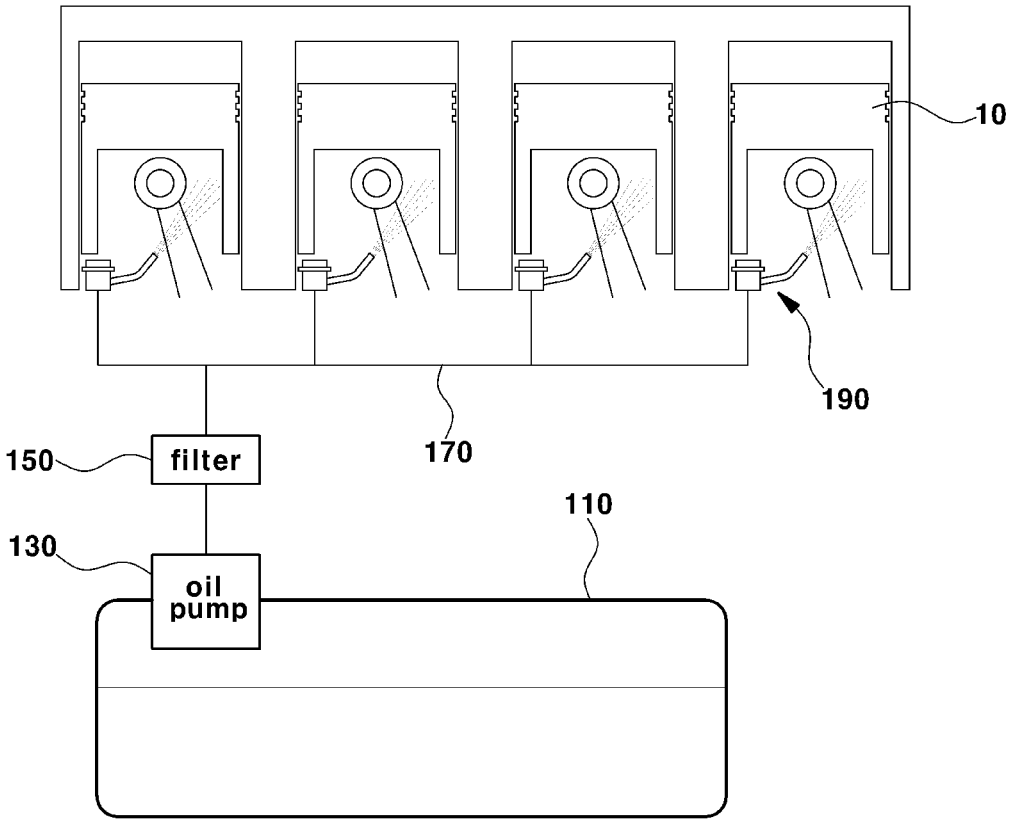
FIG. 1 is a view illustrating an apparatus for controlling oil pump pressure according to an embodiment of the present disclosure.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims. Throughout the disclosure, like reference numerals refer to like parts throughout the various figures and embodiments of the present disclosure.

The detailed description is illustrative of the disclosure. In addition, the foregoing is intended to illustrate and explain the preferred embodiments of the present disclosure, and the present disclosure may be used in various other combinations, modifications, and environments. That is, it is possible to make changes or modifications within the scope of the concept of the disclosure disclosed herein, within the scope of the disclosure, and/or within the skill and knowledge of the art. The described embodiments are intended to illustrate the best mode for carrying out the technical idea of the present disclosure and various changes may be made in the specific applications and uses of the present disclosure. Accordingly, the detailed description of the disclosure is not intended to limit the disclosure to the disclosed embodiments. It is also to be understood that the appended claims are intended to cover such other embodiments.

FIG. 1 is a view illustrating an apparatus for controlling oil pump pressure according to an embodiment of the present disclosure.

Referring to FIG. 1, the apparatus for controlling oil pump pressure may include an oil pan 110, an oil pump 130, a filter 150, a main gallery 170, and a cooling jet 190. The apparatus for controlling oil pump pressure may control the pressure of the engine oil discharged by the oil pump 130 to be a low pressure in order to increase fuel efficiency of a vehicle, and may control the pressure of the engine oil discharged by the oil pump 130 to be a high pressure when knocking occurs in an engine. The oil pan 110 may be attached to one side of the lower portion of the engine, and the oil pump 130 and the oil filter 150 may be attached to one side of a cylinder block (not shown).

The oil pan 110 may store engine oil therein. The engine oil of the vehicle may be circulated such that it is supplied to the engine via a strainer (not shown), the oil pump 110, the filter 150, and an oil cooler (not shown), and is then recovered back to the oil pan 110.

The oil pump 130 may determine a pressure for discharging the engine oil stored in the oil pan 110. The pressure of the engine oil injected into each piston 10 may be controlled by controlling the oil pump 130. The oil pump 130 may include a separate configuration for applying a pressure to the engine oil introduced thereinto. For example, the pressure at which the engine oil is injected may mean an engine oil pressure of the main gallery 170. The oil pump 130 may allow engine oil to flow to the filter 150.

The filter 150 may filter the oil stored in the oil pan 110. The filter 150 may be configured to filter the impurities contained in the oil.

The main gallery 170 may be a main passage of engine oil installed in the cylinder block (not shown). The pressure of the engine oil in the main gallery 170 may mean a pressure that the oil pump 130 according to the embodiment of the present disclosure adjusts the engine oil for discharge. The passages branched from the main gallery 170 may be connected to a plurality of cooling jets 190 for injecting engine oil into a plurality of pistons 10.

The cooling jets 190 may inject engine oil toward the pistons 10 of the engine. The cooling jets 190 may be connected to the oil passages branched from the main gallery 170. Each of the cooling jets 190 may discharge the engine oil by the pressure of the main gallery 170 determined by the oil pump 130. A typical cooling jet may be provided with a check valve to regulate the pressure of the engine oil to be discharged, but no separate valve is provided in the cooling jet 190 according to the embodiment of the present disclosure.

According to the embodiment of the present disclosure, as the oil pump 130 directly controls the degree to which the engine oil is pressurized, a separate valve for regulating the pressure at which the engine oil is discharged may not be applied to the cooling jet 190. In addition, since the apparatus for controlling oil pump pressure according to the embodiment of the present disclosure controls the pressure of the engine oil in the main gallery 170 through the oil pump 130, it may inject an appropriate amount of engine oil into the pistons of the vehicle. As a result, it is possible to prevent a knocking phenomenon caused by sudden driving and prevent an engine failure and deterioration of engine performance.

Figure 2:
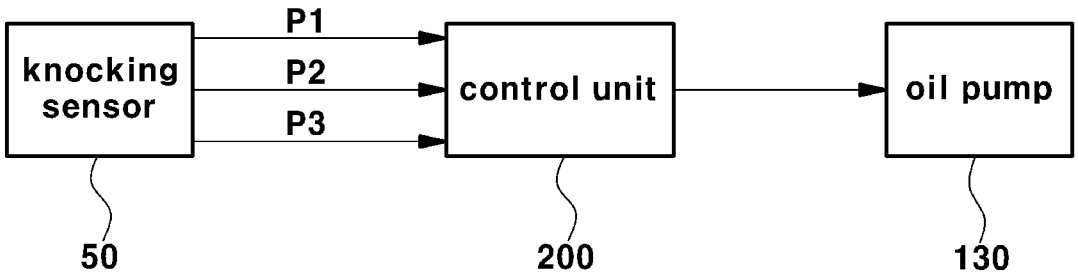
FIG. 2 is a block diagram for explaining a control unit for controlling an oil pump according to an embodiment of the present disclosure.

FIG. 2 is a block diagram for explaining a control unit for controlling the oil pump according to the embodiment of the present disclosure.

Referring to FIGS. 1 and 2, a control unit 200 may determine whether or not knocking occurs based on the parameter sensed by a knocking sensor 50. The control unit 200 may be an electronic control unit (ECU). The knocking sensor 50 may transmit a parameter for determining whether or not the knocking occurs to the control unit 200. For example, the parameter may be one of a voltage value P1, whether a bit is generated P2, and whether a preignition signal is generated P3, which are sensed through the knocking sensor 50. The knocking sensor 50 may sense whether or not vibration or preignition is caused in the engine and may transmit to the control unit 200 whether the voltage value is changed, whether the bit is generated, and whether the preignition occurs by the vibration. In general, the knocking may be prone to occur when a boost pressure is high or an intake temperature is high. Accordingly, in the embodiment of the present disclosure, the amount of engine oil injected into the piston 10 of the engine (i.e., the pressure of the discharged engine oil) is controlled to cool the piston, thereby preventing the knocking.

When the parameter is a voltage value and the voltage value sensed by the knocking sensor 50 is greater than or equal to a preset reference value, the control unit 200 may determine that the knocking occurs in the engine. For example, the preset reference value may be 3 V.

When the parameter is whether a bit is generated or whether a preignition signal is generated, the control unit 200 may determine that the knocking occurs in the engine when it is determined that the bit is generated or the preignition signal is generated.

The control unit 200 may control the degree to which the oil pump 130 pumps engine oil based on whether or not the knocking occurs in the engine, and may control the pressure of the engine oil discharged toward the piston 10 under the control of the oil pump 130. The control unit 200 may control the pressure of the engine oil discharged toward the piston 10 depending on whether or not knocking occurs, based on any one of a normal mode and a high-pressure mode. That is, the control unit 200 may control the pressure of the engine oil in the main gallery 170 by controlling the oil pump 130 based on the normal mode or the high-pressure mode depending on whether the knocking occurs in the engine. In this case, the high-pressure mode may mean that the pressure at which the engine oil is discharged when the knocking occurs in the engine is greater than or equal to a set value. The normal mode may mean that the pressure of the engine oil is controlled by an oil pressure control map stored in advance in the control unit 200. For example, the oil pressure control map may store the degree to which the oil pump 130 pumps the engine oil based on the engine speed, the temperature of the engine oil, the current pressure of the engine oil, and the like. The high-pressure mode may be a mode for discharging the engine oil to the piston 10 at a higher pressure than in the normal mode.

For example, when the parameter is a voltage value and the voltage value sensed by the knocking sensor 50 is greater than or equal to a preset reference value, the control unit 200 may control the pressure of the engine oil discharged toward the piston 10 to be greater than or equal to a set value. For example, the set value is greater than an opening pressure of the cooling jet 190, which may be 2.5 bar. However, the set value may be changed by a designer. When the voltage value sensed by the knocking sensor 50 is greater than or equal to the reference value, the control unit 200 may control the pressure of the discharged engine oil to be a set value. The high-pressure mode may allow the engine oil to be discharged at a pressure greater than or equal to the set value. When the voltage value sensed by the knocking sensor 50 is greater than or equal to the reference value, the control unit 200 may increase the pressure of the engine oil discharged in proportion to the voltage value. That is, depending on how much the voltage value is larger than the reference value, the pressure of the discharged engine oil may be increased. For example, when the voltage value sensed by the knocking sensor 50 is 3.5 V, the pressure of the engine oil discharged toward the piston 10 may be 3.0 bar, and when the voltage value sensed by the knocking sensor 50 is 4.0 V, the pressure of the engine oil discharged toward the piston 10 may be 3.5 bar.

For example, when the parameter is one of whether a bit is generated and whether a preignition signal is generated, and the knocking sensor 50 senses the generation of the bit and the generation of the preignition signal, the control unit 200 may control the pressure of the engine oil discharged toward the piston 10 to be greater than or equal to the set value.

For example, when the control unit 200 determines that the knocking does not occur in the engine, it may control the pressure at which the engine oil is discharged according to an existing oil pressure control map. That is, when it is determined that the knocking does not occur in the engine, the control unit 200 may control the oil pump 130 in the normal mode.

According to the embodiment of the present disclosure, the control unit 200 may control the oil pump 130 based on the parameter sensed by the knocking sensor 50 and may control the pressure of the engine oil discharged toward the piston 10 under the control of the oil pump 130.

The knocking may occur in the engine by the tilting of the vehicle and the engine when a yawing behavior occurs under the condition that the vehicle turns left and right and suddenly stops/starts. Such knocking may occur when the supply of engine oil to the in-cylinder piston 10 is poor. Therefore, the apparatus for controlling oil pump pressure according to the embodiment of the present disclosure can monitor the state of the vehicle through the knocking sensor 50 and supply an appropriate amount of engine oil toward the piston 10 based on the same.

Figure 3:
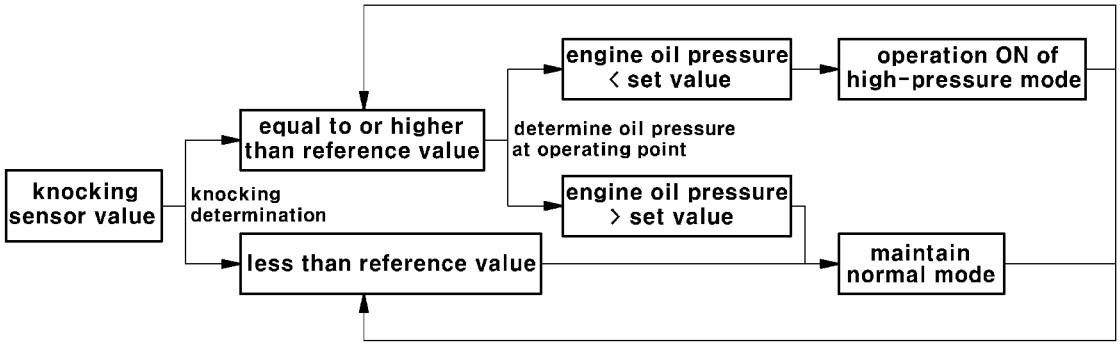
FIG. 3 is a block diagram illustrating a method of controlling oil pump pressure according to an embodiment of the present disclosure.

FIG. 3 is a block diagram illustrating a method of controlling oil pump pressure according to an embodiment of the present disclosure. In the present embodiment, it will be assumed that the parameter sensed by the knocking sensor 50 is a voltage value.

Referring to FIGS. 1 to 3, the knocking sensor 50 may be used to obtain a knocking sensor value. The knocking sensor value may be one of a voltage value, whether a bit is generated, and whether a preignition signal is generated. When the voltage value is greater than or equal to a reference value, the bit is generated, or the preignition signal is generated, and the control unit 200 may determine that the knocking occurs in the engine. When the voltage value is greater than or equal to the reference value, the control unit 200 may sense the pressure at which the engine oil is currently discharged or the pressure of the engine oil in the main gallery 170.

When the voltage value is less than the reference value, the control unit 200 may determine that the knocking does not occur in the engine, and may not increase the pressure of the engine oil discharged toward the piston 10. That is, the control unit 200 may control the oil pump 130 in the normal mode.

When the pressure at which the engine oil is currently discharged or the pressure of the engine oil in the main gallery 170 is greater than or equal to the set value, the control unit 200 may maintain the discharge of the engine oil at the current pressure. That is, since the pressure at which the engine oil is discharged is already sufficient to remove the knocking of the engine, separate control may not be required. Since the pressure at which the engine oil is discharged is already high, the control unit 200 may control the oil pump 130 in the normal mode.

When the pressure at which the engine oil is currently discharged or the pressure of the engine oil in the main gallery 170 is less than the set value, the control unit 200 may control the pressure of the engine oil discharged toward the piston 10 to be greater than or equal to the set value. In order to increase the pressure of the discharged engine oil to be greater than or equal to the set value, the control unit 200 may increase the degree to which the oil pump 130 is driven. That is, the control unit 200 may control the oil pump 130 in the high-pressure mode.

Figure 4:
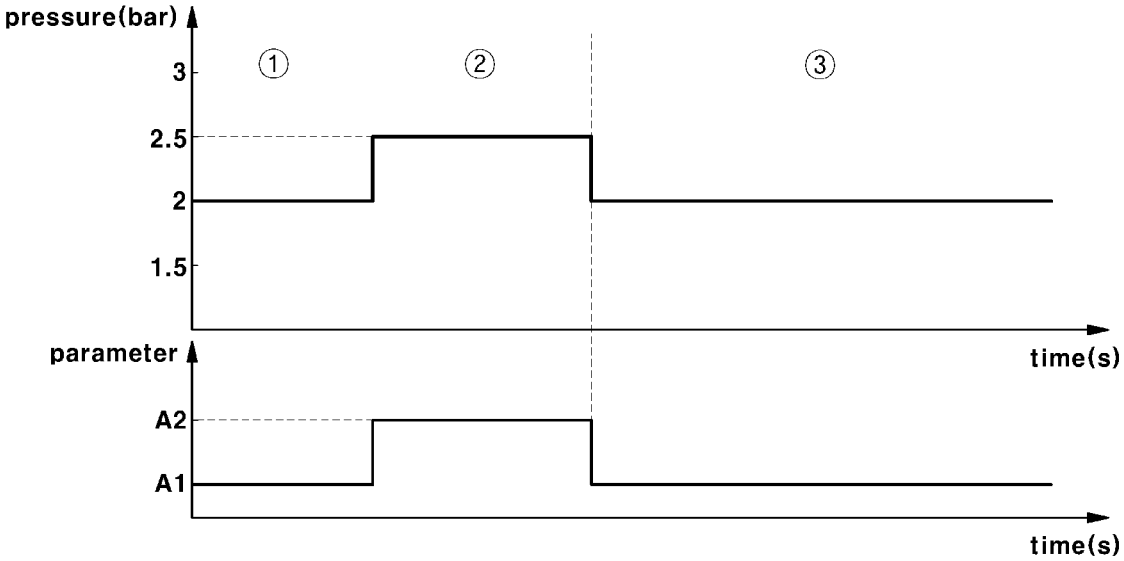
FIG. 4 is a graph illustrating a method of controlling oil pump pressure according to an embodiment of the present disclosure.

FIG. 4 is a graph illustrating a method of controlling oil pump pressure according to an embodiment of the present disclosure.

Referring to FIGS. 1, 2, and 4, the knocking sensor 50 may sense an A1 value in section ①. In this case, the A1 value may be a voltage value lower than the reference value. The A1 value may mean that no bit signal or preignition signal is sensed. In this case, since the knocking does not occur in the engine, the control unit 200 may control the oil pump 130 in the normal mode and the oil pump 130 may pump the engine oil at a low pressure. That is, the pressure of the engine oil in the main gallery 170 may be maintained at a low pressure. The control unit 200 may control the oil pump 130 to inject the engine oil at a low pressure, thereby improving the fuel efficiency of the vehicle.

The knocking sensor 50 may sense an A2 value in section ②. In this case, the A2 value may be a voltage value higher than the reference value. The A2 value may mean that a bit signal or a preignition signal is sensed. The control unit 200 may determine that the knocking occurs in the engine based on the A2 value sensed by the knocking sensor 50. When it is determined that the knocking occurs in the engine, the control unit 200 may measure the pressure of the engine oil in the main gallery 170 or the pressure of the engine oil discharged toward the piston 10. Since the pressure of the engine oil in the main gallery 170 or the pressure of the engine oil discharged toward the piston 10 is lower than the set value (i.e., low pressure), the control unit 200 may increase the pressure of the engine oil in the main gallery 170 or the pressure of the engine oil discharged toward the piston 10 to be greater than or equal to the set value. To this end, the control unit 200 may increase the degree to which the oil pump 130 pumps the engine oil.

The knocking sensor 50 may sense an A1 value in section ③. The change in the value sensed by the knocking sensor 50 from A2 to A1 may mean that the knocking in the vehicle is removed. The control unit 200 maintains the pressure of the engine oil in the main gallery 170 or the pressure of the engine oil discharged toward the piston 10 at a high pressure in section ②, with the consequence that a sufficient amount of engine oil is supplied to the piston 10 of the engine. Thus, the control unit 200 may control the pressure of the engine oil in the main gallery 170 or the pressure of the engine oil discharged toward the piston 10 to a low pressure. That is, the control unit 200 may release the driving of the oil pump 130 in the high-pressure mode and drive the oil pump 130 in the normal mode.

The apparatus for controlling oil pump pressure according to the embodiment of the present disclosure may mainly control the pressure of the discharged engine oil to be a low pressure in order to increase fuel efficiency, and may control the pressure of the discharged engine oil to be a high pressure when engine knocking occurs under various operation conditions. Accordingly, it is possible to improve engine performance by increasing the cooling efficiency of the piston 10 through the injection of engine oil injection to high pressure to prevent the retard of ignition timing, and it is possible to improve the combustion efficiency and the fuel efficiency of the vehicle through rapid cooling of the piston.

Figure 5:
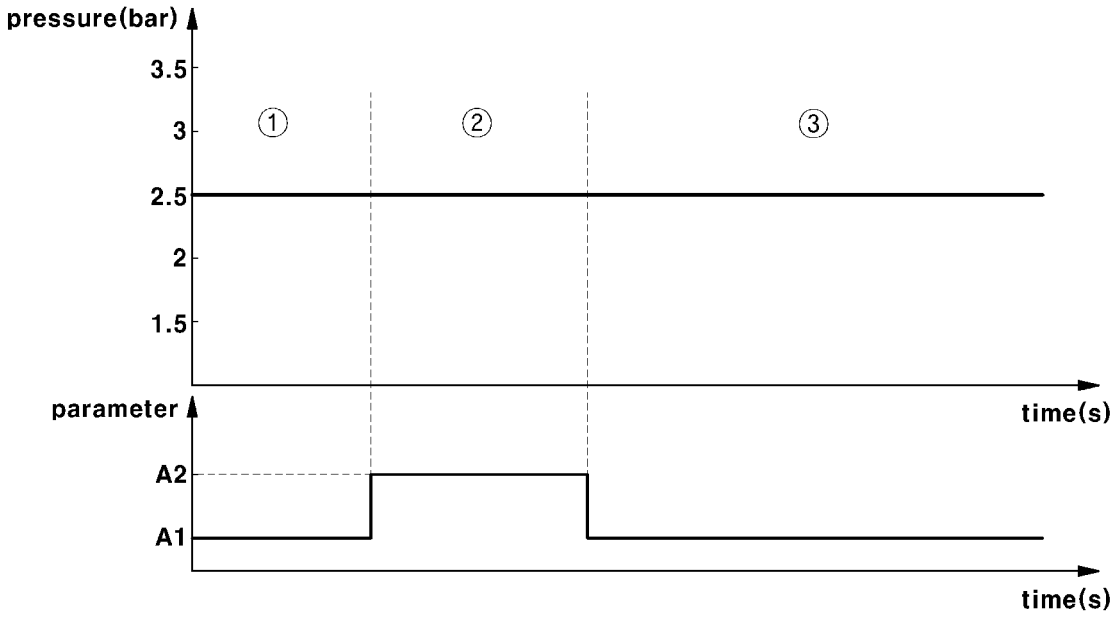
FIG. 5 is a graph illustrating a method of controlling oil pump pressure according to another embodiment of the present disclosure.

FIG. 5 is a graph illustrating a method of controlling oil pump pressure according to another embodiment of the present disclosure. For the sake of simplicity of description, the disclosure of the contents overlapping with those of FIG. 4 will be omitted.

Referring to FIGS. 1, 2, and 5, the knocking sensor 50 may sense an A1 value in section ①. When it is determined that the knocking does not occur in the engine, the control unit 200 may control the pressure at which the engine oil is discharged according to the existing oil pressure control map.

The knocking sensor 50 may sense an A2 value in section ②. The control unit 200 may determine that the knocking occurs in the engine. The control unit 200 may measure the pressure of the engine oil in the main gallery 170 or the pressure of the engine oil discharged toward the piston 10. In the present embodiment, the pressure of the engine oil in the main gallery 170 or the pressure of the engine oil discharged toward the piston 10 may be already a high pressure. That is, the pressure of the engine oil in the main gallery 170 or the pressure of the engine oil discharged toward the piston 10 may be greater than or equal to a set value. When the pressure of the engine oil in the main gallery 170 or the pressure of the engine oil discharged toward the piston 10 is already greater than or equal to the set value, the control unit 200 may maintain the pressure of the engine oil in the main gallery 170 or the pressure of the engine oil discharged toward the piston 10 at the current pressure.

Even in section ③, the control unit 200 may control the pressure at which the engine oil is discharged according to the existing oil pressure control map regardless of the value sensed by the knocking sensor 50.

When the oil pump 130 is already driven in the high-pressure mode in the embodiment of the present disclosure, the control unit 200 may not change the pressure of the engine oil in the main gallery 170 or the pressure of the engine oil discharged toward the piston 10 and may maintain it regardless of the value sensed by the knocking sensor 50.

In accordance with the exemplary embodiments of the present disclosure, it is possible to grasp the state of the vehicle through the knocking sensor 50 and control the pressure of the engine oil discharged toward the piston 10 based on the same. Thus, it is possible to prevent a knocking phenomenon caused by sudden driving of the vehicle and prevent an engine failure and deterioration of engine performance.

In accordance with the exemplary embodiments of the present disclosure, as the oil pump directly controls the degree to which the engine oil is pressurized, a separate valve for regulating the pressure at which the engine oil is discharged may not be applied to the cooling jet. Therefore, the apparatus for controlling oil pump pressure can be configured with greater simplicity.

The disclosure has been described in detail with reference to preferred embodiments thereof. However, it will be appreciated by those skilled in the art that changes may be made in these embodiments without departing from the principles and spirit of the disclosure, the scope of which is defined in the appended claims and their equivalents.

What is claimed is:

1. An apparatus for controlling oil pump pressure, comprising:

a sensor for sensing knocking of an engine;

an oil pump configured to determine a pressure for discharging engine oil toward a piston of the engine; and a control unit configured to control the pressure of the engine oil discharged toward the piston by determining whether the knocking occurs based on a parameter transmitted from the sensor for determining whether the knocking occurs, and controlling the oil pump based on whether the knocking occurs in the engine, wherein the control unit controls the pressure at which the engine oil is discharged according to an existing oil pressure control map when it is determined that the knocking does not occur in the engine.

2. The apparatus of claim 1, wherein:

the sensor comprises a knocking sensor; and the parameter transmitted from the sensor is one of a voltage value, a bit or a preignition signal.

3. The apparatus of claim 2, wherein the control unit determines that the knocking occurs in the engine when the bit is generated or the preignition signal is generated.

4. The apparatus of claim 1, wherein the control unit controls the pressure of the engine oil discharged toward the piston to be greater than or equal to a set value when the knocking occurs in the engine.

5. The apparatus of claim 4, wherein when the parameter is a voltage value and the voltage value sensed by the sensor is greater than or equal to a preset reference value, the control unit increases the pressure of the engine oil discharged in proportion to the voltage value.

6. The apparatus of claim 5, wherein when a current pressure of the engine oil discharged toward the piston is greater than or equal to the set value, the control unit maintains the pressure of the engine oil discharged toward the piston at the current pressure.

7. The apparatus of claim 1, wherein the control unit controls the pressure of the engine oil to be greater than or equal to a set value when the knocking occurs in the engine.

8. The apparatus of claim 1, wherein:

the control unit controls the pressure of the engine oil discharged toward the piston depending on whether the knocking occurs, based on any one of a normal mode and a high-pressure mode;

the high-pressure mode means that the pressure at which the engine oil is discharged when the knocking occurs in the engine is greater than or equal to a set value; and the high-pressure mode is a mode for discharging the engine oil at a higher pressure than in the normal mode.

9. The apparatus of claim 1, further comprising a cooling jet for injecting the engine oil toward the piston, wherein the control unit controls the oil pump to control the pressure of the engine oil in a main gallery connected to the cooling jet.

* * * * *